United States Patent [19]

Sullivan, II

[11] 3,985,081

[45] Oct. 12, 1976

[54] RAIL TRANSPORTATION SYSTEM

[76] Inventor: Ennis Cornelius Sullivan, II, 3947 Cedar Bayou, Dallas, Tex. 75234

[22] Filed: Mar. 13, 1975

[21] Appl. No.: 557,991

[52] U.S. Cl. ..... 104/23 FS; 104/118; 104/125; 104/242; 105/141

[51] Int. Cl.[2] ..... B61B 13/04

[58] Field of Search ..... 104/23 R, 23 FS, 89, 104/91, 93, 106, 107, 118, 119, 120, 124, 125, 134, 244, 242, 245, 246, 248; 105/141, 144, 145, 148, 150, 151, 153

[56] References Cited

UNITED STATES PATENTS

| | | | |
|---|---|---|---|
| 3,168,875 | 2/1965 | Reed | 104/134 |
| 3,190,235 | 6/1965 | Bertin et al. | 104/134 |
| 3,198,139 | 8/1965 | Dark | 104/120 X |
| 3,286,651 | 11/1966 | Dahl, Jr. | 104/118 X |
| 3,319,581 | 5/1967 | Churchman et al. | 104/119 X |
| 3,865,040 | 2/1975 | Steen | 104/118 X |
| 3,890,904 | 6/1975 | Edwards | 104/121 |

FOREIGN PATENTS OR APPLICATIONS

| | | | |
|---|---|---|---|
| 1,253,735 | 1/1961 | France | 104/119 |

*Primary Examiner*—L. J. Paperner
*Assistant Examiner*—Randolph A. Reese
*Attorney, Agent, or Firm*—Richards, Harris and Medlock

[57] ABSTRACT

The specification discloses a transport system comprising a track including a horizontal top rail with a vertical web extending below the rail. A canted surface extends between one edge of the horizontal rail and the web. A support member extends angularly from the vertical web opposite the canted surface of the track. A transport unit is mounted on the track and includes motorized wheels rotationally supported on the unit for tracking along the surface extending angularly from the web. Counterbalance wheels are rotationally supported on the unit for tracking the canted surface of the track. The unit has its center of gravity outside the contact surfaces between the motorized and counterbalance wheels and the track and to the side of the web face on which the motorized wheels track. The transport unit is adapted to channel air between the underside of the main body of the unit and the horizontal rail of the track to lift the transport unit thereby relieving the loading of the unit on the track. The unit is adapted with sensor devices for venting air from beneath the underside of the transport unit to vary the lift resulting from the flow of air between the unit and the track for maintaining at the unit a constant distance from the track.

15 Claims, 7 Drawing Figures

RAIL TRANSPORTATION SYSTEM

FIELD OF THE INVENTION

This invention relates to a transportation system which travels along an elevated track, and more particularly to a transport unit having contact with the track along two surfaces with the center of gravity of the transport unit acting outside of both surfaces of contact.

PRIOR ART

During the last decade, there has been an increasing consciousness of the need for mass transportation systems for the movement of people and cargo both in and between metropolitan areas. With the increase in population of all metropolitan areas, the need for a system which offers a high level of comfort to the passengers and which is economically practical has been ever increasing.

Therefore, a primary objective of any new system is the development of a system which is stable and smooth riding through all modes of operation. The unit should resist "sway" and "roll" caused by dynamic loading introduced by movement of the units over the track. The points of contact between the passenger or payload units and the track should limit or eliminate the transmittal of track irregularity into those units.

Of great importance is the economic feasibility of the system. To reduce the cost below present day systems, it must require use of a minimum of new land area or operate through unused air space. It must be capable of installation without interference with present transportation systems and should make use of present transportation and other structures to eliminate duplicative construction effort. It must be flexible in its transportation capabilities as well as nonpolluting. It should also be characterized by ease of application to provide transporation through areas heretofore inaccessible because of difficult terrain. Further, the transporting unit must be light in weight to reduce the cost of construction and of propelling the unit without jeopardizing the comfort and stability of the ride.

While many of the prior art units have attempted to satisfy each of these requirements, systems presently used fail to embody a transportation system which is stable during all modes of operation and adapted for economical use and construction. All of the systems heretofore used have required the use of three or more surfaces of contact between the transportation unit and the track over which the unit is moved. Similarly, the prior art units have required the use of very complex track systems and have generally failed to embody a stable, low cost and flexible transportation unit.

SUMMARY OF THE INVENTION

The present invention provides an improved transportation system which overcomes many of the shortcomings heretofore found in earlier transportation systems. In accordance with one embodiment of the present invention, a transportation system includes a track consisting of a horizontal rail having a vertical web extending below the rail and supported intermediate of the edges of the rail. A canted surface extends angularly between one edge of the rail and the web. The track is longitudinally continuous to form a route over which the transportation system extends. A transport unit is mounted on the track with its center of gravity offset from the web. Motorized drive wheels extend from the transport unit and track along a face of the web. Rotational counterbalance wheels extend from the transport unit and ride on the canted surface of the track. The center of gravity of the transport unit acts outside of the surfaces contacted by the rotational wheels. This arrangement provides a transport system which moves along a track where there are only two surfaces of contact between the rotational support wheels and the track. Therefore, only two smooth surfaces are required to produce a smooth riding system. Because the center of gravity acts outside of the surfaces of contact between the transport unit and the track, the unit will be remarkably stable during all modes of operation, and a sufficiently high force will be generated between the drive wheels and the track web to assure adequate traction over the entire transportation system.

In accordance with another embodiment of the invention, a triangular support member protrudes from the vertical web and extends longitudinally along the full length of the track. In this embodiment, the motorized drive wheels are canted to ride flat on the upper surface of the support member.

In accordance with another embodiment of the invention, the transport unit is mounted on the track and extends above the horizontal rail with a portion of the transport unit extending to one side and below the horizontal rail so that the center of gravity is offset outside the surfaces of contact between the rotational wheels and the track. The transport unit is adapted to channel air between the underside of the unit and the horizontal rail. As the air is channeled beneath the vehicle, a high pressure is created thereunder generating a lift force on the unit and relieving loading on the track. Sensors control the venting of air from beneath the vehicle as needed to vary the lifting effect on the unit to maintain a constant vertical relationship between the unit and the track. Sensors also control the rotation of the motorized drive wheels about an axis perpendicular to their axis of rotation to maintain the transport unit in a fixed position on the track during movement of the unit over the track.

In accordance with another embodiment of the invention, the transport unit extends substantially below the horizontal rail and to the side of the contact surface on the web along which the rotational drive wheels track.

In accordance with still another embodiment of the invention, vertical support members are attached to the track at spaced intervals along the continuous length thereof to elevate the track and transport unit above the ground. By providing a track system which is relatively simple in construction and compact in size such that it may be easily raised above the ground level, the present system introduces a transportation means which may be economically competitive with all present day transportation methods. Because the track may be raised above the ground, no new land would have to be acquisitioned for the construction of the system. The system may be constructed over existing roadways or over existing right-of-ways which are used other than for transportation purposes such as drainage or sewage right-of-ways. Because of the ease of construction of the unit, the system could be installed without interfering with the continued use of present transportation systems. Additionally, the system is highly flexible in that it may be extended above the ground level where free ground space is lacking and relatively close to or on the ground where land costs are relatively low. Further, the relative ease with which the present invention may be elevated above the ground, makes its use particularly adaptable to terrains which would not heretofore permit the construction of an on-ground transportation system. This would include construction of the present system through forest and swamp areas, in addition to mountainous and other irregular terrains.

In accordance with still another embodiment of the invention, the track system is suspended by support members extending from existing building structures. This parasite construction is again made possible by the relative simplicity and the compactness of the present invention. The use of existing structures permits the construction of a transportation system in areas where ground right-of-ways are unobtainable and eliminates the need for the construction of new bridges and like structures where the present system may be attached to existing structures.

In accordance with still another embodiment of the invention, electrical leads are mounted to the underside of the track rail for supplying electrical power to the transport unit. Means are provided on the main body of the transport unit corresponding to the electrical leads attached to the rail for contacting the electrical leads to furnish electrical power to the drive wheels. Because the electrical leads are attached to the underside of the track rail, this means of power to the transport unit is effectively shielded from all weather conditions. In this way, the transportation system would be operable in all weather use in areas where ice and snow would otherwise be a problem.

DESCRIPTION OF THE DRAWINGS

For a more complete understanding of the present invention, and for further objects and advantages thereof, reference is now made to the following description taken in conjunction with the accompanying drawings in which.

DESCRIPTION OF THE PREFERRED EMBODIMENTS

Figure 1:
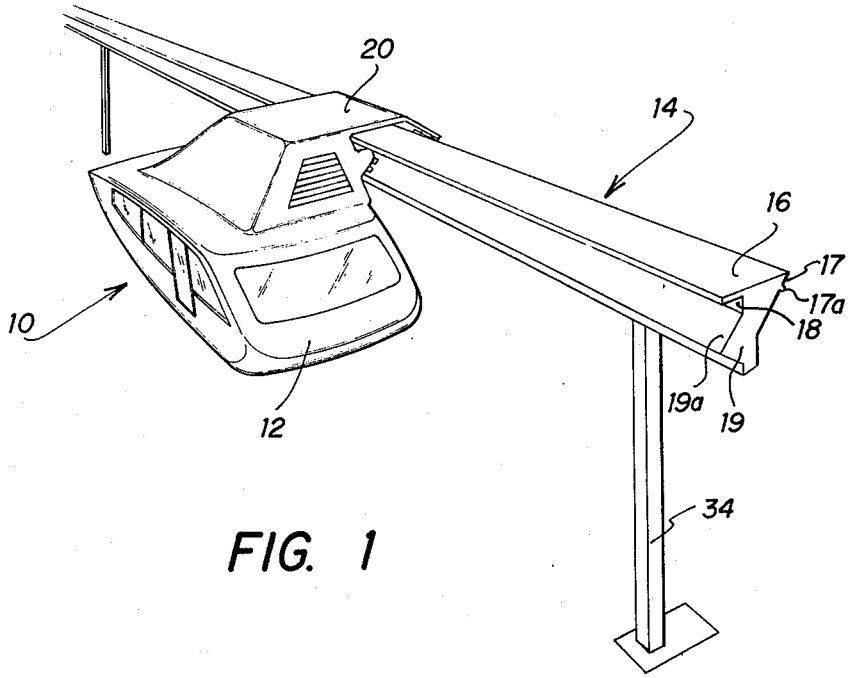
FIG. 1 illustrates a perspective view of a preferred embodiment of the present invention.
Figure 2:
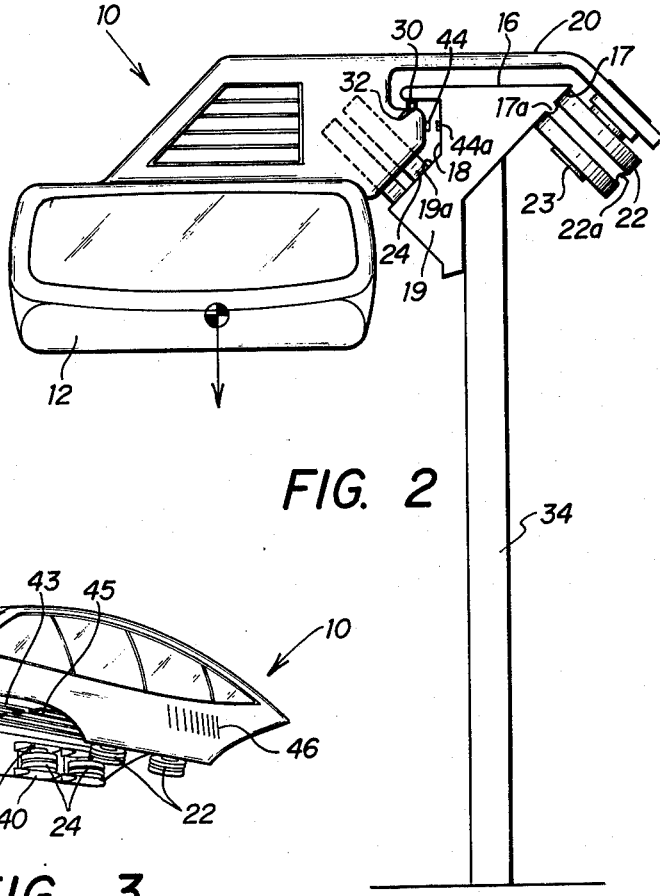
FIG. 2 is a front view of the preferred embodiment shown in FIG. 1.

FIGS. 1 and 2 illustrate in perspective and frontal views, respectively, one embodiment of the present invention. In this embodiment, transport unit 10 is suspended from a track 14 consisting of a horizontal rail 16, a vertical web 18 extending below rail 16 intermediate of the edges of the rail and a surface 17 extending between one edge of rail 16 and vertical web 18. Extending from vertical web 18 longitudinally along the length of the track 14 is a triangular support 19 having an upper surface **19*a* forming an angle with the vertical web approximately equal to that angle which surface 17 forms with rail 16.**

Transport unit 10 is mounted for movement along track 14. Arm 20 extends above track 14 from a main body 12 and supports counterbalance wheels 22 to track on surface 17 of track 14. Counterbalance wheels 22 are rotationally attached to arm 20 by shaft 23 and are formed with treads **22*a* which run on the raised protrusion 17*a* in surface 17 of track 14. Power or drive wheels 24 are rotationally attached to the main body 12 for tracking on the upper surface of support member 19. The design of surface 17 at an angle to horizontal rail 16 facilities the transmission of loading from the counterbalance wheels 22 to track 14. Similarly, canting of surface 19*a* of support member 19 facilitates the transmission of loading from power wheels 24 to track 14.**

In this configuration, transport unit 10 is mounted on track 14 such that there are only two surfaces of contact between the transport unit and the track, namely surfaces 17 and **19*a*. Thus, there need only be two smooth surfaces in order to insure a smooth and uniform movement of the transport unit along the track. The center of gravity of the transport unit is offset from vertical web 18 and acts outside the surfaces of contact between transport unit 10 and track 14. This arrangement generates a sufficient load between power wheels 24 and surface 19*a* of support member 19** to assure continuous contact and traction between the power wheels and the track.

Because the center of gravity of the transport unit is offset outside of the surfaces of contact between transport unit 10 and track 14, the stability of the transport unit is markedly increased as there is much less tendency for the unit 10 to oscillate about its points of contact with the supporting track. Because the unit is extended in the offset position, much larger dynamic forces would be required to interrupt the stable movement of the transport unit than would otherwise be the case. Additionally, the present design provides a system wherein there are only two surfaces of contact between the transport unit and supporting track 14 thereby only requiring that two surfaces and two sets of tracking wheels be harmonized for the stable and comfortable movement of the unit over the track.

The loading on surface 17 by counterbalance wheels 22 and on triangular support member 19 by power wheels 24 will vary with the dimension between the two surfaces of contact and with the line of action of the center of gravity of the transport unit 10. The magnitude and point of action of the center of gravity will vary with the design of the transport unit 10 and the positioning of passengers within the main body 12. By varying these factors, the loading of the counter-balance wheels 22 and the power wheels 24 on track 14 will vary, both in magnitude and in vector direction. Referring to FIG. 2, with the center of gravity acting outside of the surfaces of contact between the transport unit and the track 14, the line of action of the load exerted on the track by counterbalance wheels 22 and power wheels 24 will generally be perpendicular to the canted surfaces 17 and **19*a*, respectively, on which the counterbalance and power wheels ride. While the surfaces of contact are illustrated as being at an angle of approximately 45° from horizontal, there will be optimum angles at which the two surfaces of contact must be positioned depending upon the factors previously mentioned. Therefore, with the design of the transport unit and the track structural dimensions necessary to support the static and dynamic loading of the transport unit, there will be a corresponding optimum angle or angles at which the surfaces 17 and 19***a* may be positioned so that the loads exerted by the counterbalance wheels and power wheels are directed perpendicularly thereon. By designing the contact surfaces at an angle such that the loads exerted thereon by the counterbalance and power wheels are perpendicular thereto, the tendency of the transport unit to move relative to these support and contact surfaces will be considerably lessened and the restraint built into the system to prevent movement of the transport system relative to the contact surfaces will only be subjected to loading resulting from the dynamic movement of the transport unit along the track.

Attached to the underside of rail 16 are electrical leads 30 extending longitudinally along track 14 for the entire length thereof. Extending from transport unit 10 are terminal means 32 corresponding to electrical leads 30 for contacting the electrical leads and thereby furnishing electrical power to motorize drive wheels 24. Because the electrical leads 30 are attached to the underside of rail 16, they are substantially shielded from the weather and other contaminating elements which could otherwise interfere with the transfer of electrical power from track 14 to transport unit 10. While it is readily recognized that other modes of power may be used to propel drive wheel 24, such as internal combustion or turbine engines, the use of electric engines produces a system which is pollution free and consistently dependable. Likewise, power may be supplied to the power wheels 24 and to the counterbalance wheels 22. However, because of the higher contact loads between the drive wheels 24 and support surface 19*a* than between counterbalance wheels 22 and surface 17, power to drive wheels 24 alone should be sufficient where the transfer unit is maintained relatively light.

Vertical support members 34 are attached to track 14 at spaced intervals along the length thereof. The support members 34 elevate the track, and therefore the transport unit, a sufficient distance above the ground level as required by the particular area over which the transportation system is laid. Because of the relatively simple and compact track employed by the present invention, the system may be easily elevated above the ground to use the same right-of-way used by existing transportation systems. Thus, the system eliminates or substantially reduces the need for acquisition of new land space for the construction of the system.

Figure 4:
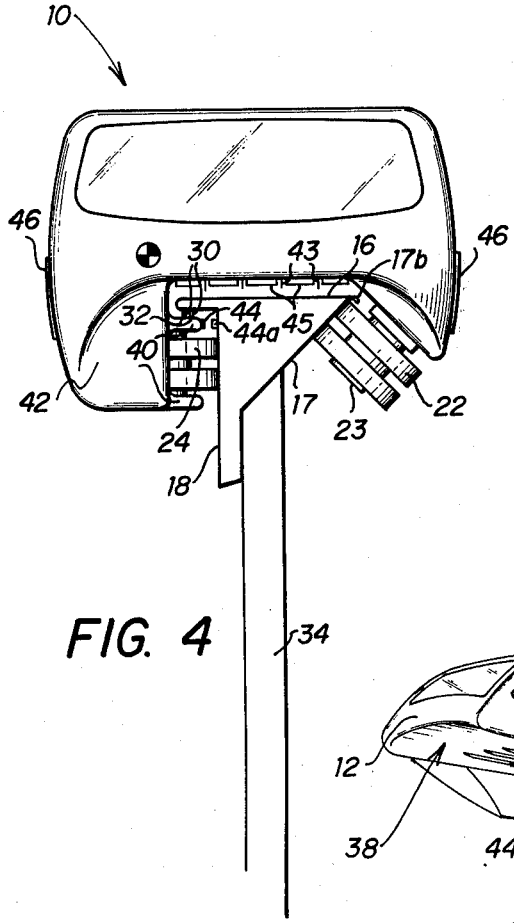
FIG. 4 is a front view of the preferred embodiment shown in FIG. 3 with the transport unit mounted on the track.
Figure 3:
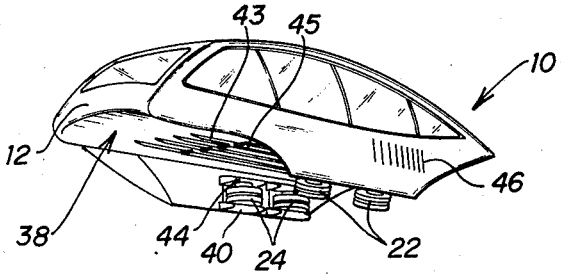
FIG. 3 is a perspective view of another preferred embodiment of the present invention where the transportation unit is shown removed from the track.

FIGS. 3 and 4 illustrate in perspective and frontal views, respectively, another embodiment of the transportation system of the present invention. In this configuration, the main body 12 of transport unit 10 is positioned above track 14. Counterbalance wheels 22 are rotationally attached to the underside of transport unit 10 and are canted so that the circumferential face of the wheels ride flat against surface 17 of track 14. Power wheels 24 extend horizontally between arms 40 attached to counterbalance pod 42 and track the face of vertical web 18. Pod 42 is adapted to accept the electric motors and other major components necessary to operate the transport unit and to provide the facilities necessary to the passenger compartment. With the substantial weight of such components relative to the envisioned lighter structure of the transport unit body, the center of gravity of the total transport unit 10 acts outside of the two surfaces of contact between the transport unit and the track. As hereinabove described, the stability of the unit is greatly improved as a result of the positioning of the center of gravity outside of the surfaces of contact, and the tendency of the unit to sway or "rock" on the track is greatly reduced. This embodiment is similarly adapted with electrical terminal means 32 attached to upper arm 40 which corresponds to the electrical leads 30 attached to the underside of rail 16 to provide electrical power to the transport unit.

In this embodiment, counterbalance wheels 22 do not track along a protrusion guide in surface 17, although a safety lip 17*b* extends from the edge of horizontal rail 16 to prevent counterbalance wheels 22 from moving up and off of the track. The positions of both the counterbalance wheels and the power wheels are controlled by the rotation of power wheels 24 about a horizontal axis perpendicular to the vertical web 18 of track 14. By rotating the power wheels about this axis, the power wheels will track up or down the vertical web 18 of track 14 to compensate for lack of vertical support of power wheels 24 during movement of the transport unit along the track. The rotation of power wheels 24 is controlled by sensors 44 which electrically track a reference line 44*a* extending longitudinally along the full length of track 14 on the vertical web 18 of the track. As the sensors 44 perceive the movement of the transport unit below the reference line 44*a* appropriate servo mechanisms (not shown) translates arms 40 to rotate power wheels 24 about a horizontal axis causing the power wheels to track upward along vertical web 18 of track 14 to restore the sensing unit to its in line position with the reference line 44*a*. As the unit reaches this in line position, the sensors output causes the power wheels to rotate to a neutral or straight ahead position thereby arresting the movement of the transport unit upwardly on the track.

As is best illustrated in FIG. 3, the front of transport unit 10 has a front scoop 38 to entrap and channel air between the transport unit body and the horizontal top rail 16 of track 14 during movement of the transport unit along the track. Channel members 43 extend longitudinally along the underside of main body 12 to more uniformly channel the air flow passing between the main body and track 14. As the transport unit reaches a sufficient speed, air channeled between the bottom of the transport unit and the horizontal rail 16 of track 14 generates a high pressure beneath the unit tending to lift the transport unit 10 away from the track. This resultant lift relieves the force exerted by power wheel 24 against vertical web 18 of track 14. The front scoop may have variable top and side members permitting the enlargement or narrowing of the frontal inlet area to control the amount of air entering below the transport unit and thereby controlling the lift effect caused by the flow of air between the transport unit and the track. As the lifting effect due to the channeling of air beneath the transport unit and the track increases with the increase of speed of the unit along the track, sensors 44 activate the servo mechanisms controlling the rotation of the power wheels such that the sensors maintain a continuous in line relationship with the reference line 44*a*. Where necessary, the servo mechanism controlled by sensors 44 may even be directed to rotate the power wheels to track down vertical web 18 of track 14 to counterbalance the lifting forces caused by the flow of air between the transport unit and the track.

Additionally, the lifting effect caused by the passage of air between the transport unit and the track may be adjusted by two other techniques. In the areas along the track where the transport unit will maintain a high speed, top rail 16 of track 14 may be narrowed to allow more air passing beneath the main body to escape around the track thereby decreasing the lift force generated by the air flow. In this configuration, counterbalance wheels 22 are translatable along the underside of transport unit 10 so that counterbalance wheels 22 continue to track surface 17 of track 14 as the track narrows. In this way, the system is made more economical in that the track cost is reduced by permitting a reduction in the dimensions of the track over certain areas.

The system is also equipped with a secondary means for reducing the lift effect resulting from the flow of air between the underside of the transport unit and the track. This means includes scoops 45 extending from the underside of the transport unit and connected by way of ducts (not shown) to side vents 46. As the lifting effect resulting from the flow of air underneath the transport unit raises the unit above the reference level 44*a* as sensed by sensors 44, scoops 45 are automatically lowered into the flow channels beneath the transport unit, and air is exhausted through the duct system and out the side of the unit through vents 46. Scoops 45 are automatically raised as sensors 44 indicate that the unit approaches the reference position. In this way, the lifting effect caused by the air flowing beneath the transport unit is controlled to maintain sensors 44 in line with reference line 44*a*.

As is best seen in FIG. 3, additional lift is generated by the flow of air around the exterior surface of the transport unit. The main body 12 is shaped with a positive camber, generating a resulting lift force on the body surface as the vehicle moves along the track. The lift coefficient may be varied by varying the shape of the vehicle used in the system. Variable flaps and slats may also be incorporated, as may spoilers, to control the lifting force acting on the transport body. This resultant lift force will relieve the pressure exerted by power wheels 24 on track 14.

As is shown in the perspective view of FIG. 3, there are two sets of power wheels 24 attached between arms 40 which extend from transport unit 10 through pod 42. Likewise, there are two sets of counterbalance wheels 22 rotatably attached to the underside of transport unit 10. It will be clear to those skilled in the art that the number of power wheels 24 and counterbalance wheels 22 will be dictated by design and the choice of two sets in the present drawings is purely by way of illustration. The number of wheels may be increased if a greater distribution of loading is necessitated.

Referring to FIG. 2, each set of power wheels are independent wheels joined by a common axle, with each counterbalance wheel being a single unit having a circumferential groove therein adapted to mate with the guide protrusion 17*a* raised on surface 17. As illustrated in FIG. 4, an alternative embodiment is the use of independent wheels for both the counterbalance and power wheel units coupled by axles extended therethrough.

Figure 5:
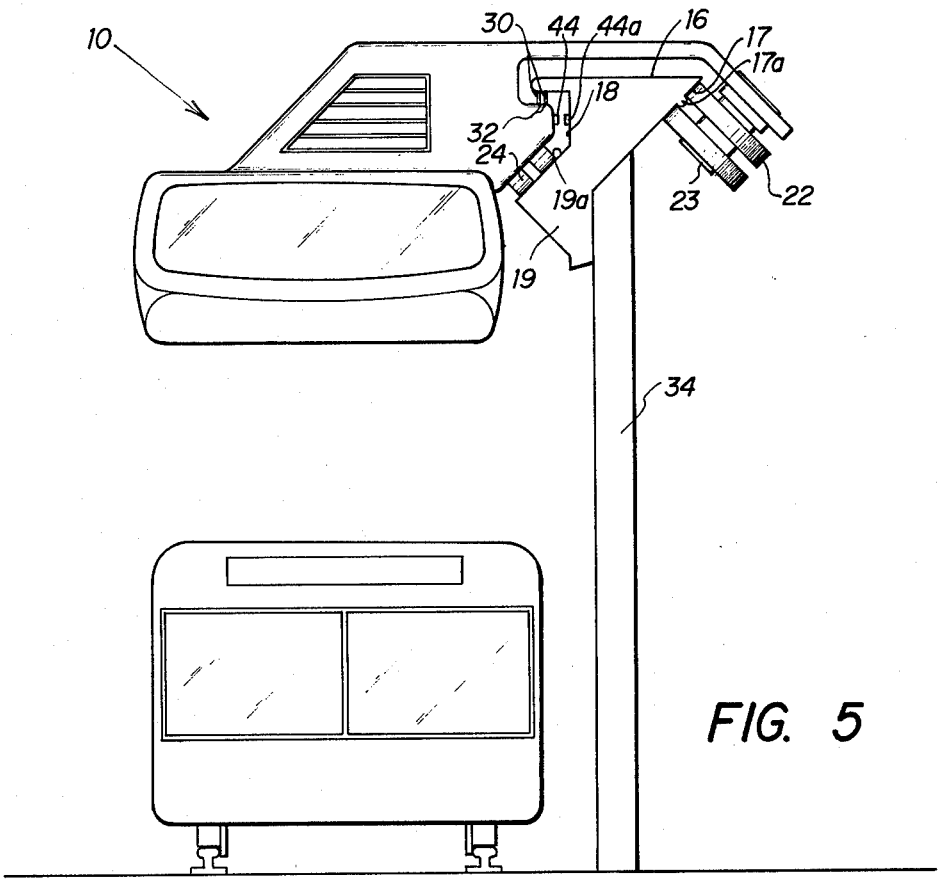
FIG. 5 is a front view of an alternative embodiment of the present invention showing the present invention using the right-of-way of an existing transportation system.

FIG. 5 illustrates the placement of the transportation system of the present invention immediately above an existing conventional train transportation system. Such a construction effectively eliminates any need of acquiring new land space or right-of-ways for the present transportation system thereby substantially reducing the cost of the system.

Figure 6:
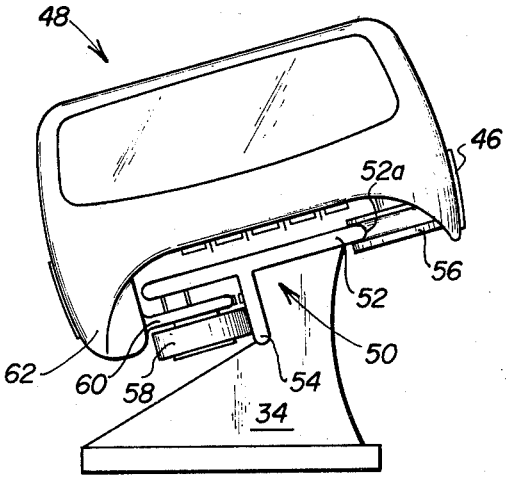
FIG. 6 is a front view of an alternative embodiment of the present invention showing the track banked.

FIG. 6 illustrates an alternative embodiment of the transport unit and track configuration as it would appear at a point where the track is banked at a turn in the track. In this embodiment, transport unit 48 is positioned above track 50 consisting of a horizontal top rail 52 having a vertical web 54 attached longitudinally along the length of the track 50 intermediate of the edges of rail 52 and extending below the rail. Counterbalance wheels 56 are rotationally attached to the underside of transport unit 48 and engage and track edge 52*a* of top rail 52. Power wheels 58 extend horizontally from arms 60 attached to counterbalance pod 62. Power wheels 58 track the face of web 54. As previously described, pod 62 is adapted to accept the electric motor and other major components of the transport unit. As a result of positioning these components to one side of the main body, the center of gravity of the total transport unit 48 acts outside of the two surfaces of contact between the transport unit and the track. As has been previously discussed, loading on rail 52 by counterbalance wheels 56 and on web 54 by power wheels 58 will vary with the dimension between the two surfaces of contact and with the line of action of the center of gravity of the transport unit. While the magnitude and point of action of the center of gravity will vary with the design of the transport unit and the positioning of passengers within the main body, the line of action of the center of gravity will also vary with the angle of bank incorporated in a particular turn. These factors will govern the loading exerted by counterbalance wheels 56 on rail 52 and the power wheels 58 on web 54. The forces exerted by the transport unit through power wheels 58 on web 54 must always be of a sufficient magnitude to maintain the stability of the transportation system. It will therefore be understood that in the design of track 50, transport unit 48, the angle of bank used in turns of the track and passenger distribution must all be coordinated to assure that the loading on web 54 by power wheels 58 does not drop below an acceptable value required to maintain a superior stability which results from the configuration of the present invention. Limiting the bank angle and maintaining a center of gravity sufficiently outside of the surface of contact between the power wheels 58 and web 54 will assure the necessary loading to maintain the stability of the system.

FIG. 6 further illustrates support member 34 which is used where the transportation system may move close to ground level as where the cost of a surface right-of-way is relatively low. Thus the present transportation system has the flexibility of being readily adaptable to being elevated in areas where there are existing ground transportation or other right-of-ways but no relatively low cost ground space, while permitting the transportation unit to be carried relatively close to the ground where the cost of a surface right-of-way is relatively low thereby eliminating the cost of elevating the system.

Figure 7:
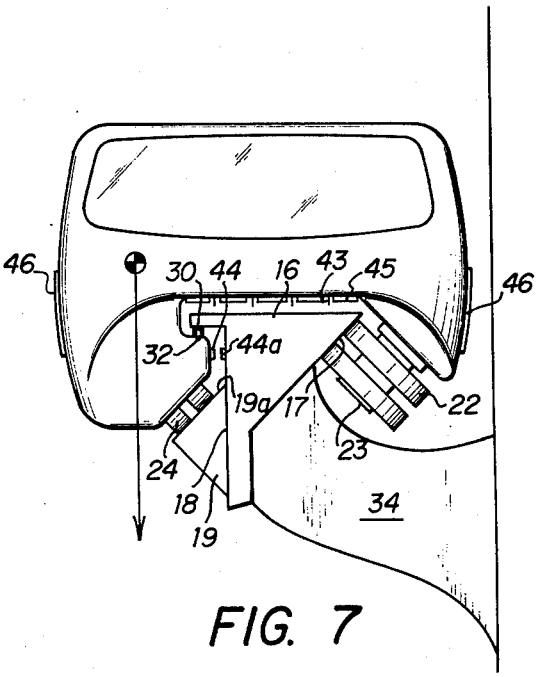
FIG. 7 is a front view of an alternative embodiment of the present invention wherein the track is suspended from a preexisting structure.

The support member 34 illustrated in FIG. 7 depicts a concept of parasiting wherein the present transportation system may be attached to existing structures such as buildings or bridges where the system may not be economically positioned at ground level and where elevation of the unit from the ground by means of support struts would not be feasible. In this way, existing structural foundations may be used to carry the present transportation system thereby eliminating the need of constructing an independent support structure.

Thus, the present invention describes a transport system including a track having a horizontal top surface, a vertical surface extending below the horizontal surface intermediate of the edges thereof and a surface extending inwardly and below one edge of the horizontal surface to the vertical surface. The track is continuous over the route through which the transportation system extends. A transportation unit is mounted on the track and has motorized drive wheels extending from the transport unit and tracking along an angularly extending support from the vertical surface of the track. Counterbalance wheels extend from the transport unit and track on the canted surface of the track extending from the horizontal surface to the vertical surface. The center of gravity of the transport unit acts outside the two surfaces of contact made by the drive wheels and the counterbalance wheels with the track. This arrangement provides a transport system which moves along a track where there are only two surfaces of contact between the transport unit and the track. Because the center of gravity acts outside of these two surfaces of contact, the unit is remarkably stable during all modes of operation.

The transport unit body is designed to entrap and channel air between the underside of the transport unit and the horizontal surface of the track to create a lifting force to relieve the loading exerted by the transport unit on the track. The main body of the transport unit is shaped in the form of an airfoil thereby generating a resultant lift force on the body as it moves along the track. In one configuration, the power wheels are rotatable to track upwardly or downwardly along the vertical surface of the track to maintain the transport unit at a constant relationship with the track.

Further, the track is of such fundamental construction and is so compact that the system may be readily elevated above the surface of the ground. Therefore, no new lands would have to be acquisitioned for the construction of the system. The system may be constructed over existing roadways or over existing right-of-ways where only the ground surface right-of-ways are actually in use. Because of the ease of construction of the unit, the system could be installed without interferring with the continuing use of present systems. The system may be extended above the ground level where free ground space is lacking and relatively close to or on the ground where land costs are relatively low. The transportation system may also be supported from existing structures such as buildings and bridges, where such structures are capable of bearing additional loads. This parasite construction eliminates the need of constructing duplicative elevating support structures as well as eliminating the need for obtaining new land space for the transportation system. Because the electrical power to the unit is supplied by leads attached to the underside of the track rail, the supply of power is effectively shielded from weather and other contaminants thereby making the system operable in all weather conditions.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A transport system comprising:

a track including a horizontal top rail with a vertical web extending downwardly therefrom and a canted surface extending between one edge of said horizontal rail and said web, said canted surface being adapted with a raised protrusion formed thereon and extending longitudinally along the length of said track; and a transport unit mounted on said track having a motorized rotational support pivoted on said unit for tracking along a vertical surface of said web and a counterbalance rotational support pivoted on said unit for tracking on the canted surface of said track, said counterbalance rotational support having a circumferential groove therein for mating with said raised protrusion to restrain the movement of said counterbalance rotational support across the surface of said canted surface, said unit having its center of gravity acting outside the surfaces of contact between said rotational supports and said track and to the side of said vertical web on which said motorized rotational support tracks.

2. The transport system of claim 1 wherein said transport unit is adapted to channel air between the underside of said transport unit and said horizontal rail of said track to lift said transport unit thereby relieving the loading of said unit on said track.

3. The transport system of claim 2 wherein said transport unit is adapted with a means for venting air from between the underside of said transport unit to vary the lift resulting from the flow of air between said unit and said track.

4. The transport system of claim 3 wherein said means for venting said air is actuated by a sensor device actuated by the vertical movement of the transport unit relative to the said track.

5. The transport system of claim 1 wherein:

said vertical web extends below said rail and is attached intermediate of the edges of said rail;

and further comprising electrical leads attached to the underside of said rail for supplying electrical power to said unit; and means on said unit corresponding to the electrical leads attached to said rail for contacting said electrical leads to furnish electrical power to said motorized rotational support.

6. The transport system of claim 1 and further comprising support members having a predetermined height attached to said track at spaced intervals along the length thereof for elevating the transport system above the ground.

7. The transport system of claim 6 wherein the height of said support members are varied to accommodate variations in terrain along its route.

8. The transport system of claim 6 wherein said support members are supported from existing support structures for suspending the transport system adjacent said existing structures.

9. The transport system of claim 1 wherein said transport unit comprises:

a main body positioned above said horizontal rail, with said counterbalance rotational support extending below said main body for tracking on said canted surface; and a side compartment extending below said main body to the side of said track opposite said canted surface, said motorized rotational support extending from said side compartment for tracking on said vertical web, said side compartment having a predetermined weight such that the center of gravity of said transport unit acts outside the surfaces of contact between said rotational support and said track and to the side of said track on which said side compartment extends.

10. A transport system comprising:

a track including a substantially horizontal top surface having a vertical web extending downwardly therefrom and a canted surface extending between one edge of said horizontal surface and said web, a support surface extending angularly from the face of said web opposite said canted surface; and a transport unit mounted on said track having at least two motorized wheels rotationally supported on said unit for tracking on said support surface and at least two counterbalanced wheels rotationally supported on said unit for tracking along said canted surface, said motorized rotational support wheels being adapted for rotation about an axis perpendicular to said support surface whereby said motorized rotational wheels may be made to track upwardly or downwardly as the unit moves along said track.

11. The transport system of claim 10 and further comprising a sensing device adapted to sense the movement of said transport unit relative to said track, said sensing device adapted to control the rotation of said motorized rotational wheels about said horizontal axis to maintain a preselected relationship between said transport unit and said track.

12. A transport system comprising:

a track including a horizontal rail having a vertical web with both said web and said rail continuous along the length thereof; and a transport unit mounted on said rail with the center of gravity offset from said web with a first rotational support pivoted on said unit between said center of gravity and said web to track along one face of said web and a second rotational support pivoted on said unit above said first support adapted with a circumferential groove therein for mating with the edge of said rail facing away from said one face of said web wherein the mating of said groove with said edge of said rail restricts vertical movement between said transport unit and said track.

13. The transport system of claim 12 wherein said transport unit comprises a main body mounted above said horizontal rail having said second rotational support pivoted therefrom and a pod unit extending from said main body and positioned to one side and below said horizontal rail so that the center of gravity of said transport unit is offset from said web, said pod unit supporting said first rotational support for tracking along one face of said web.

14. The transport system of claim 12 wherein said first rotational support comprises at least two wheels rotationally supported on said unit for tracking along one face of said web, and further comprising motor means within said unit for driving said wheels.

15. The transport system of claim 12 and further comprising vertical support members having a predetermined height attached to said track at spaced points along the length thereof for elevating the transport system above the ground.

* * * * *